United States Patent [19]

Robinson

[11] 4,319,370

[45] Mar. 16, 1982

[54] BASE FOR A BED

[75] Inventor: James D. Robinson, Welwyn Garden City, England

[73] Assignee: Imperial Chemical Industries Limited, London, England

[21] Appl. No.: 83,951

[22] Filed: Oct. 11, 1979

Related U.S. Application Data

[63] Continuation-in-part of Ser. No. 968,434, Dec. 8, 1978, abandoned.

[30] Foreign Application Priority Data

Oct. 5, 1978 [GB] United Kingdom ..... 39410/78

[51] Int. Cl.[3] ..... A47C 19/00; A47C 19/20

[52] U.S. Cl. ..... 5/201; 5/186 R; 5/400; 108/56.1; 312/108

[58] Field of Search ..... 5/186 R, 191, 200, 201, 5/400, 401; 108/56.1, 56.3; 312/108, 111

[56] References Cited

U.S. PATENT DOCUMENTS

| | | | |
|---|---|---|---|
| 3,824,933 | 7/1974 | Lind | 108/56.1 |
| 3,878,796 | 4/1975 | Morrison | 108/56.1 |
| 3,913,154 | 10/1975 | Sweeney | 5/186 B |
| 4,062,301 | 12/1977 | Pitchfork | 108/56.1 |
| 4,128,907 | 12/1978 | Gilbert | 5/200 |
| 4,186,452 | 2/1980 | Underwood | 5/400 |

FOREIGN PATENT DOCUMENTS

| | | |
|---|---|---|
| 1554014 | 10/1969 | Fed. Rep. of Germany . |
| 499295 | 1/1971 | Switzerland . |
| 1308852 | 3/1973 | United Kingdom . |

*Primary Examiner*—Alexander Grosz

*Attorney, Agent, or Firm*—Cushman, Darby & Cushman

[57] ABSTRACT

A base for a bed comprising (preferably two or four) light-weight thermoplastics platforms interlocked together by couplings which engage skirts and lugs depending from the platforms so as to prevent rotation of one platform relative to another. The platforms are easily separated for transport by a vertical lifting force yet they resist separation by unintentional rotational forces caused by sitting on or lifting their peripheral edges.

8 Claims, 20 Drawing Figures

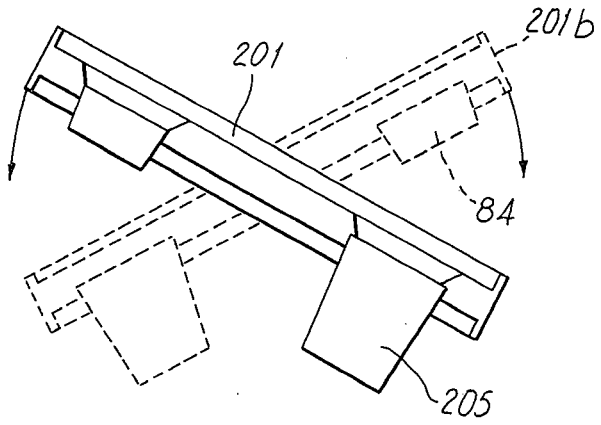
Fig. 18.
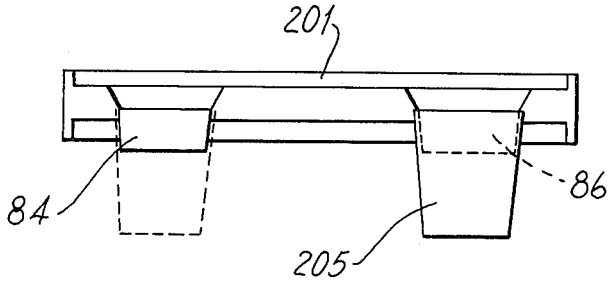
Fig. 19.
Fig. 20.
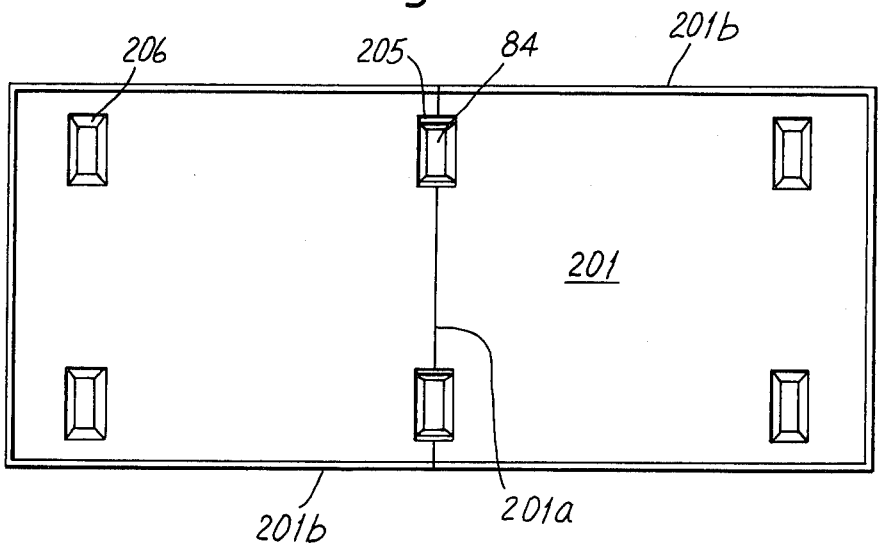

BASE FOR A BED

This application is a Continuation-in-part of our U.S. Ser. No. 968,434 dated Dec. 8, 1978, now abandoned.

This invention relates to a base for a bed.

Traditional bases for beds have comprised large and heavy metal or wooden structures which are expensive to make and difficult to manoeuvre through confined spaces such as doorways, stairwells and short corridors.

It has been proposed to make light-weight components for chairs from moulded thermoplastics materials but a single component big enough to provide a body-supporting surface for a base for a bed is not only too large to be easily transportable but it has also proved to be too large for convenient moulding. It is preferred to avoid bolting together two or more smaller thermoplastics platforms to make up a larger component because the heavy and shifting weight of a restless prostrate human body generates high stresses at the places where the metal bolts engage the thermoplastics platforms.

West German Patent specification No. 1 554 014 (published in 1969) discloses a base for a bed made from foamed thermoplastics platforms coupled together to provide a body-supporting surface. DE No. 1 554 014 employs couplings which are clips each having a pair of opposed depending arms which fit over upstanding flanges formed in the platforms. Unless the clips make a tight interference fit over the flanges, they will be easily displaced by a downwards movement of the platforms such as occurs when someone sits on a platform, especially if the platform is standing on a thick pile carpet or an uneven floor. Displacement of the clips can lead to a dangerous separation of the platforms. If the clips make a tight fit (a tight fit is not disclosed by DE No. 1 554 014), they become difficult to remove by hand without the use of tools and so make intentional separation of the platforms more difficult. This difficulty is aggravated by the small size of the clips which makes them awkward to grip. Moreover, evenly tightly fitting clips are liable to work free in time.

DE No. 1 554 014 also discloses couplings which dove-tail horizontally into the platforms. The dove-tailed surfaces of the couplings require that the couplings be inserted into carefully aligned platforms and the alignment requires skill and also plenty of space for manoeuvre. Also once fully inserted, these dove-tailed couplings cannot be easily removed without the use of tools.

French patent specification 2 293 897 (published in 1976) discloses a base for a bed made from thermoplastics platforms coupled together to provide a body-supporting surface. The platforms are coupled by means of horizontal mortices and tenons. The horizontal tenons resist separation by a downwards movement of the platforms but are vulnerable to separation by horizontal forces such as occur if someone pulls on an end of the base to move it about a room.

An object of this invention is to provide a base for a bed which can be quickly, easily and safely assembled (by hand without the need to use tools) from platforms which can be easily moulded in thermoplastics materials. Pairs of the platforms are coupled together in such a way that in order to make the base more easily transportable, the platforms can be easily separated by an intentionally applied force, yet the coupled pairs resist separation by unintentionally applied forces such as occur when someone sits on, lifts or pulls one end or side of a platform. A preferred object is to make use of the weight of the platforms and any load they carry to bias them into a coupling engagement so as to resist any long term tendency for them to work free of the coupling.

Accordingly, this invention provides a base for a bed, the base comprising at least one pair of coupled laterally adjacent thermoplastics platforms having horizontal surfaces for use in supporting a prostrate human body, and at least one coupling which holds together a pair of laterally adjacent platforms in such a way that an edge of one platform of a pair is opposed to an edge of the other platform of the pair characterised in that:

(a) the coupling comprises opposed upstanding spaced surfaces restrained from moving apart by one or more interconnections, (b) each platform of a laterally adjacent pair is provided with:

(i) an outer depending surface which extends downwards and opposes an outer depending surface of the other platform of the pair, and (ii) an inner depending surface which extends downwards and enters between the upstanding surfaces of the coupling, and opposes an upstanding surface, whereby reaction between the opposed outer depending surfaces and reaction between an inner depending surface and the upstanding surface resists a rotation of one platform of a pair relative to the other platform about an axis parallel to their opposed edges. Preferably, the upstanding surfaces of the coupling form part of a support for the body-supporting surface of the base so that a load on the body-supporting surface biasses one or more of the platforms into engagement with the coupling.

The bases can be quickly, easily and safely assembled without a need to use tools simply by lowering inner depending surfaces of the platforms between and into engagement with opposed upstanding surfaces of a coupling and thereafter the platforms can be easily separated by a carefully applied lifting force which does not impart to the platforms any significant moment tending to rotate one platform of a laterally adjacent pair relative to the other platform about an axis parallel to the opposed edges of the platforms.

Optionally, the base may additionally comprise one or more shims sandwiched between opposed outer depending surfaces of laterally adjacent platforms. If the shim makes an interference fit, there are greater frictional forces between the opposed surfaces which increase resistance to unintentional separation of the platforms. However, tightly fitting shims usually require tools to remove them from between the platforms although over a period of time they may work loose. Therefore, it is preferred that the opposed outer depending surfaces of a pair of laterally adjacent platforms abut each other. Accordingly, if increased resistance to unintentional separation is required, it is preferred to achieve this by the provision of co-operating engaging means on laterally adjacent platforms. For example, one platform may have a tongue which engages a corresponding groove in the adjacent platform, preferably with a snap fit.

It is also preferred that a base for a double bed comprises at least four adjacent platforms, arranged in diagonally adjacent pairs and laterally adjacent pairs.

Preferably, the platforms are made from injection moulded thermoplastics materials which comprise crystalline (preferably aliphatic) polyolefins optionally blended with a rubber, for example, an optionally diene modified rubbery copolymer of ethylene and propylene. The preferred polyolefin is a polymer of propylene which may be a homopolymer or a copolymer of propylene with up to 20% by weight of ethylene and is preferably a copolymer with 6 to 12% of ethylene. A further alternative polyolefin is polyethylene, especially high density polyethylene of the kind made using transition metal catalysts. The platforms are preferably made from rigid structures comprising a core of closed-cell foamed polyolefin enclosed within a skin of polyolefin and commonly called "structural foams". The couplings and supports may be made from the same materials as the platforms.

The components of a base according to this invention may be conveniently supplied in kit form ready for subsequent assembly.

By way of example, embodiments of this invention will now be described with reference to the drawings of which:

FIG. 1 is a perspective view of a base for a double bed according to this invention;

FIG. 2 is a plan on a larger scale of the underside of platform 4 shown in FIG. 1 with the positions of adjacent platforms 1, 2 and 3 indicated by dashed lines;

Figure 2:
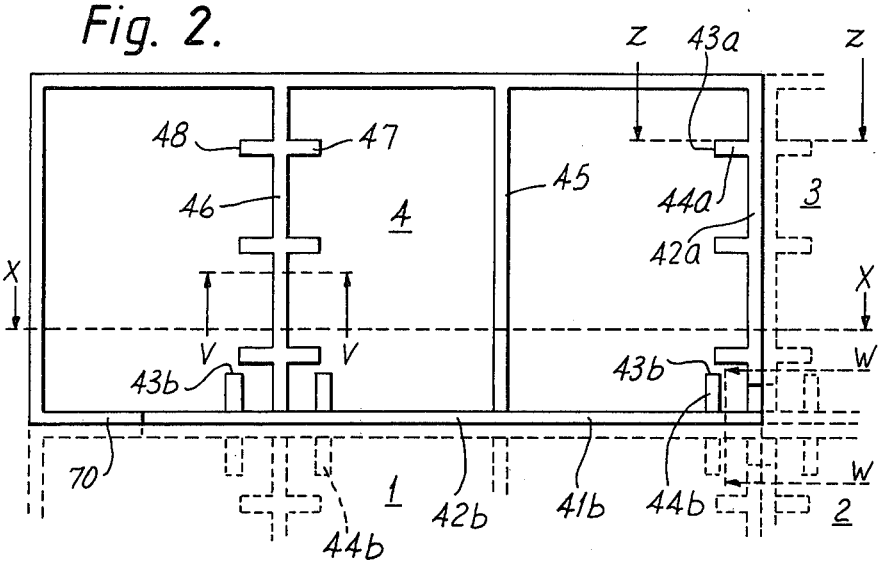
Figure 5:
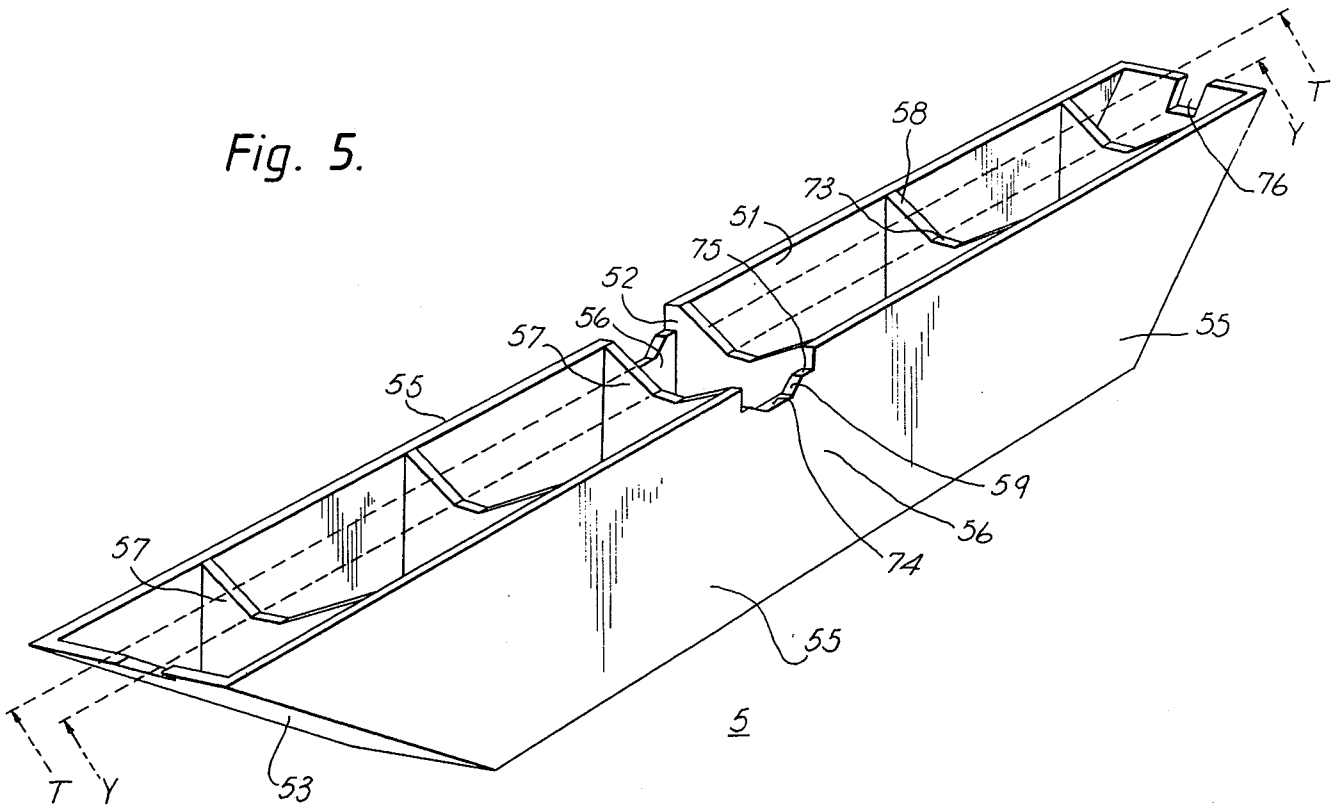
FIG. 5 is a perspective view on a larger scale of foot 5 shown in FIG. 1.
Figure 11:
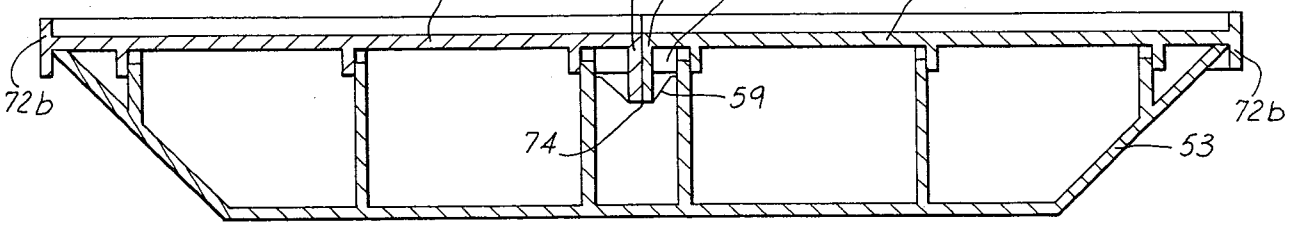
Figure 8:
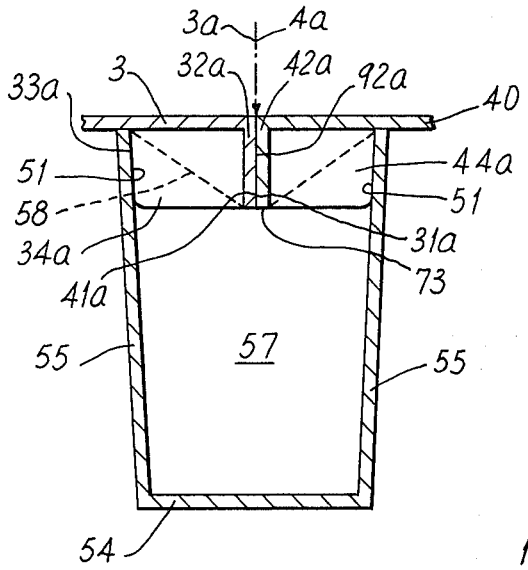
Figure 9:
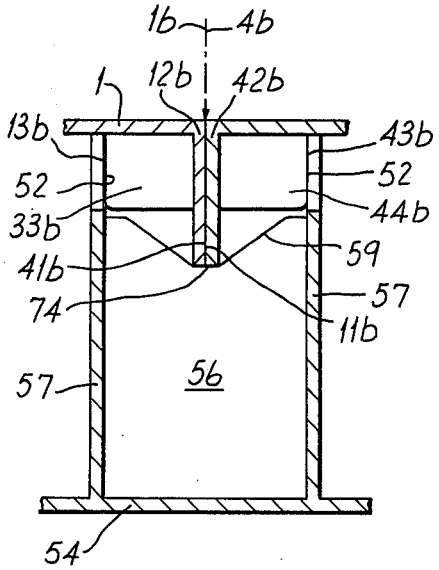
Figure 10:
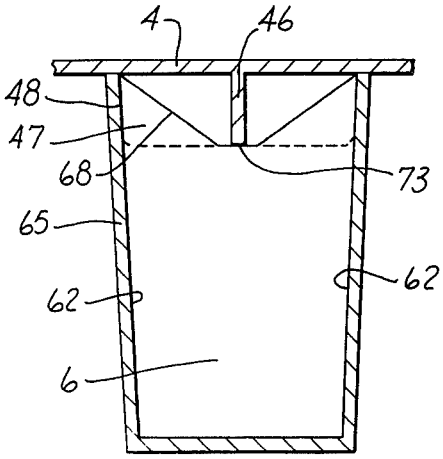
Figure 12:
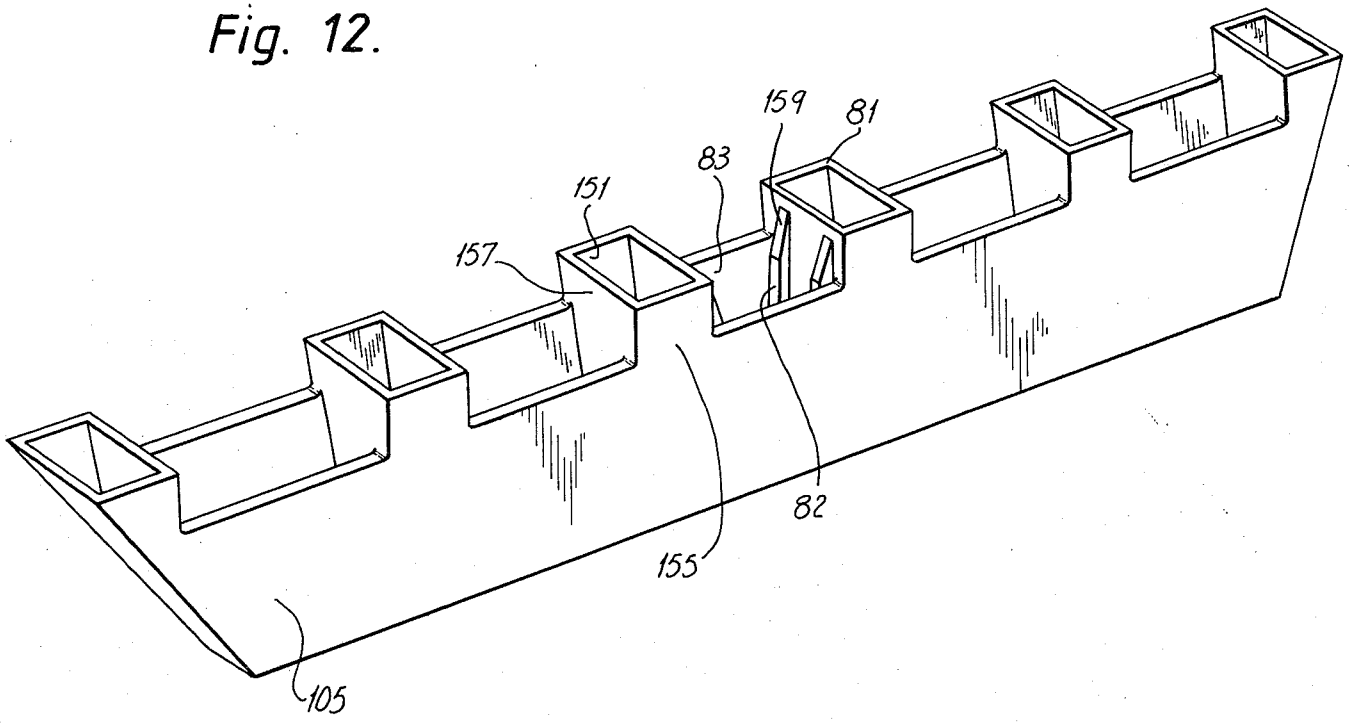
Figure 13:
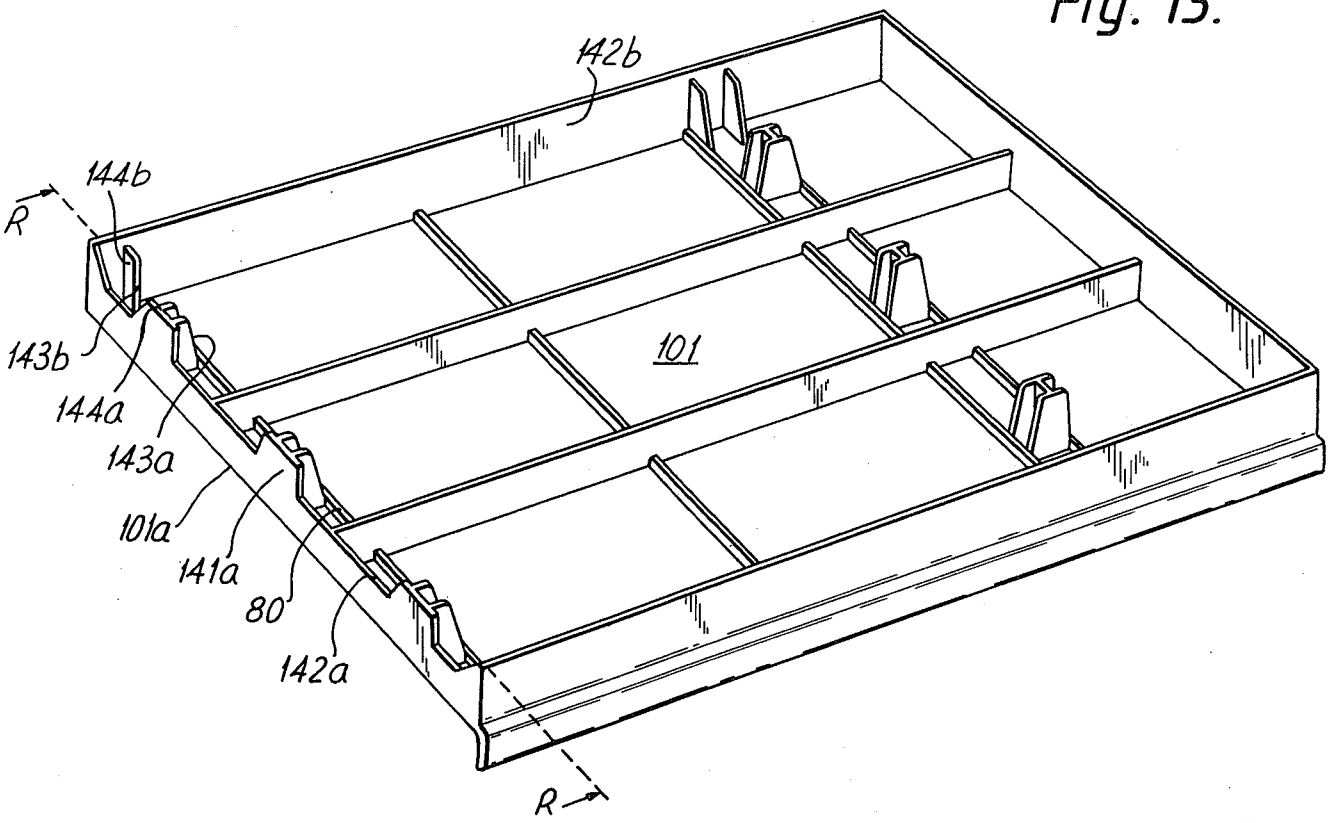
Figure 14:
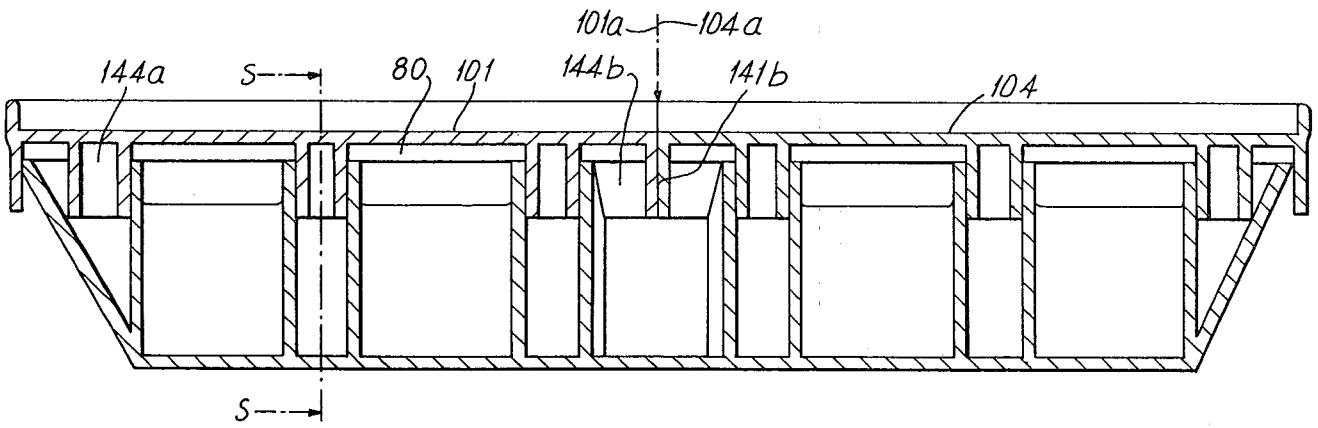
Figure 15:
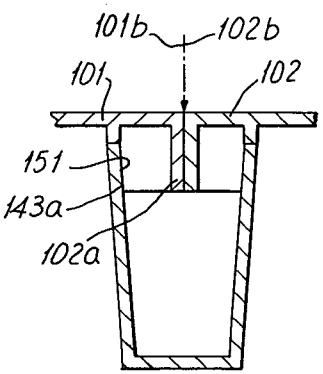
Figure 16:
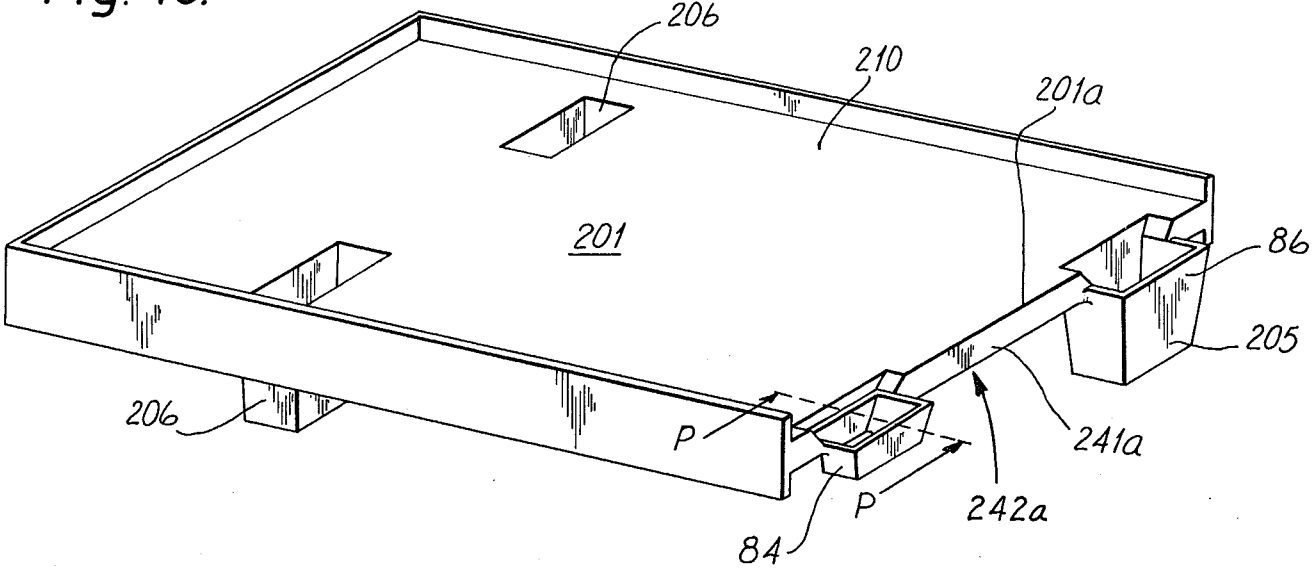
Figure 17:
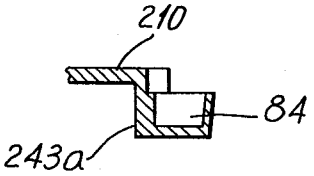

FIG. 8 is a section on a larger scale of platforms 3 and 4 taken on line Z—Z shown in FIG. 2 when supported on foot 5;

FIG. 9 is a section on the same scale as FIG. 8 but taken on the line W—W shown in FIG. 2;

FIG. 10 is a section on the same scale as FIGS. 8 and 9 and taken on the line V—V shown in FIG. 2 and showing foot 6 in section;

FIG. 11 is a section of foot 5 on a smaller scale taken on line T—T shown in FIG. 5 and showing platforms 1 and 4 in section;

FIG. 12 is a perspective view of a modified foot;

FIG. 13 is a perspective view on a smaller scale of the underside of a modified platform for use with the foot shown in FIG. 12;

FIG. 14 is a section of a pair of modified platforms assembled on a modified foot, the section being taken on the line R—R in FIG. 13;

FIG. 15 is a section on the line S—S in FIG. 14;

FIG. 16 is a perspective view of a platform for a base for a single bed, the platform having integral feet;

FIG. 17 is a part section on the line P—P in FIG. 16;

FIGS. 18 and 19 are diagrams illustrating the method for assembling the platforms shown in FIG. 16;

FIG. 20 is a plan of a pair of assembled platforms.

Figure 1:
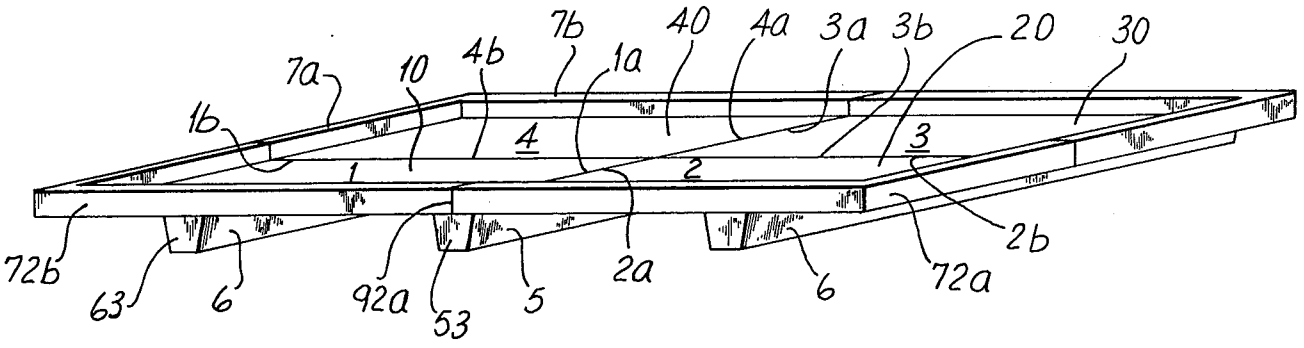

FIG. 1 shows a base for a double bed comprising four adjacent platforms 1, 2, 3 and 4 having flat horizontal surfaces 10, 20, 30 and 40 for use in supporting a prostrate human body (not shown). Platforms 1 and 3 are a diagonally adjacent pair as are platforms 2 and 4. Each of platforms 1, 2, 3 and 4 forms a coupled laterally adjacent pair with two of the other platforms, for example, platform 4 is laterally adjacent platforms 1 and 3. Each platform has mutually perpendicular edges 1*a* and 1*b*, 2*a* and 2*b*, 3*a* and 3*b* and 4*a* and 4*b* which oppose corresponding edges on the other laterally adjacent platforms of a pair. For example, mutually perpendicular edges 4*a* and 4*b* oppose edges 3*a* and 1*b*. Platforms 1, 2, 3 and 4 stand on central supporting foot 5 and on one of two flanking supporting feet 6. Feet 5 and 6 carry opposed upstanding surfaces 51, 52 and 62 (as shown in FIGS. 5 to 11) which form part of couplings which hold together coupled laterally adjacent platforms as hereinafter described.

Platforms 1, 2, 3 and 4 have upstanding flanges 7*a* and 7*b* for locating a mattress (not shown). Platforms 1 and 3 are of opposite hand to (i.e. mirror images of) platforms 2 and 4 but otherwise all four platforms are identical and so only platform 4 will be described in detail.

Figure 3:
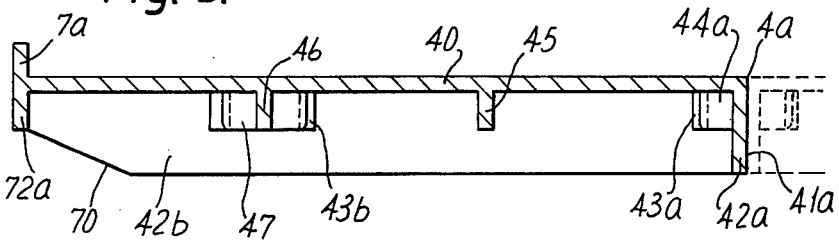
FIG. 3 is a section on line X—X shown in FIG. 2.
Figure 4:
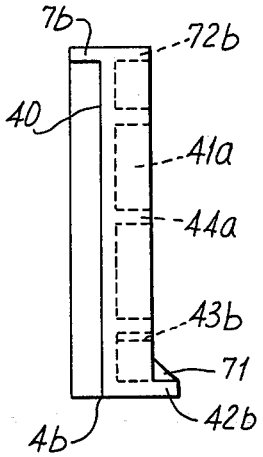
FIG. 4 is an end elevation of platform 4 shown in FIG. 2.

As shown in FIGS. 2, 3 and 4, platform 4 has mutually perpendicular outer depending surfaces 41*a* and 41*b* (provided by skirts 42*a* and 42*b*) which depend from edges 4*a* and 4*b* respectively. Platform 4 also has mutually perpendicular inner depending surfaces 43*a* and 43*b* provided by lugs 44*a* and 44*b* which extend inwardly from skirts 42*a* and 42*b* respectively. Inner depending surfaces 43*a* are inclined at an angle of 2.5° to the vertical to facilitate their entry between opposed upstanding surfaces 51 of foot 5 during assembly of the base.

Skirt 42*b* has a chamfered end 70 (FIG. 3) to reduce weight and is strengthened by web 71 (FIG. 4). Platform 4 also has strengthening ribs 45 and 46, rib 46 being provided with transverse fins 47 for engaging foot 6 as shown in FIG. 10. Edges 48 of fins 47 are also inclined at an angle of 2.5° to the vertical to facilitate engagement of fins 47 with foot 6 during assembly of the base. Platform 4 has peripheral depending trims 72*a* and 72*b*. As shown in FIG. 11, trim 72*b* assists in locating platform 4 on foot 5 and similarly (though not shown) on foot 6.

Figure 6:
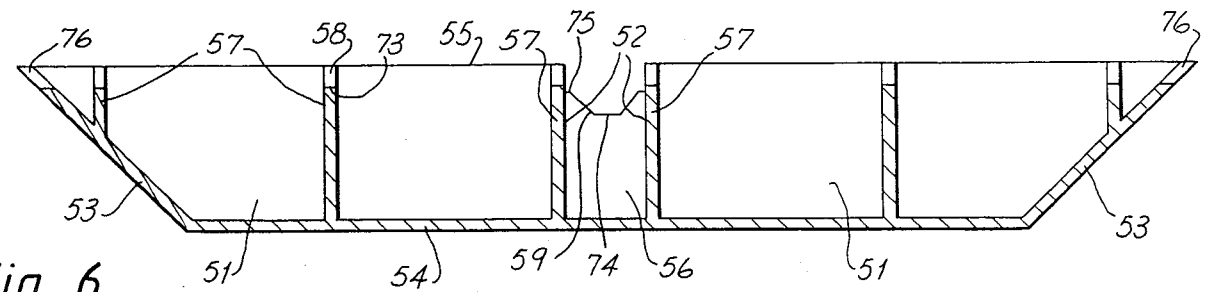
FIG. 6 is a section on a smaller scale taken on line Y—Y shown in FIG. 5.
Figure 7:
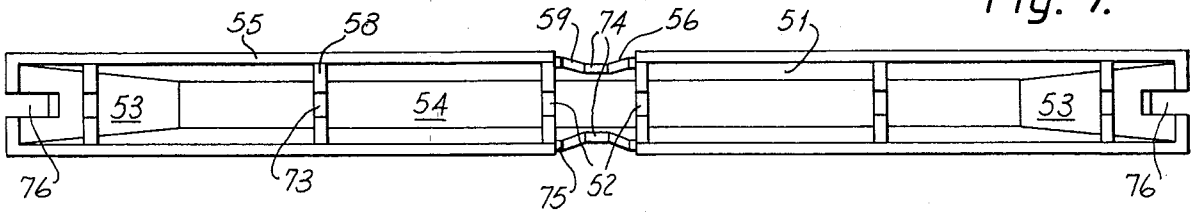
FIG. 7 is a plan on a smaller scale of foot 5 shown in FIG. 5.

FIGS. 5, 6 and 7 show central foot 5 which has a box-like structure comprising ends 53, base 54 and slightly inclined upstanding walls 55 (see FIG. 8) which carry a central portion 56, slightly inclined upstanding opposed surfaces 51 and upright rigid transverse ties 57 which interconnect opposed surfaces 51 and restrain them from moving apart. Ends 53 also function as ties. Opposed surfaces 51, ties 57 and ends 53 constitute a first coupling forming part of foot 5 for holding together pairs of coupled laterally adjacent platforms 1, 2, 3 or 4. Walls 55 and opposed surfaces 51 are inclined at an angle of 2.5° to the vertical so as to be able to make a push fit with inclined inner surfaces 43*a* of lugs 44*a*.

Foot 5 also comprises a second pair of opposed upstanding spaced surfaces 52 which are provided by the central pair of ties 57 and which are restrained from moving apart by interconnections consisting of central portions 56 of walls 55. Opposed surfaces 52 and central portions 56 constitute a second coupling forming part of foot 5 for holding together pairs of laterally adjacent platforms 1, 2, 3 or 4, the second coupling being transverse to the first.

The tops of ties 57 and interconnecting central portions 56 have slopes 58 and 59 which slope downwardly and inwardly to horizontal central shelves 73 and 74 respectively so as to assist in locating skirts 42*a* and 42*b* on shelves 73 and 74 respectively during assembly of the base. The top of interconnecting central portions 56 also have short terminal shoulders 75 to facilitate moulding.

Ends 53 are inclined at an angle of 45° to the vertical for styling purposes. Ends 53 contain notches 76 for receiving skirts 42*a* during assembly of the base.

Feet 6 are identical with foot 5 although only their second (or transverse) coupling is utilised in holding together pairs of coupled laterally adjacent platforms 1, 2, 3 or 4.

In assembling the base, central foot 5 is placed parallel to and between flanking feet 6 as shown in FIG. 1. Outer depending surfaces 41*a* and 41*b* and inner depending surfaces 43*a* and 43*b* of platform 4 are then lowered in foot 5 while fins 47 are lowered into one of feet 6 whereupon:

(a) trim 72*b* engages both a top edge of an end 53 of foot 5 (as shown in FIG. 11) and similarly a top edge of an end (not shown) of a foot 6 so as to partially locate platform 4 on feet 5 and 6, (b) skirt 42*b* and lugs 44*b* enter between opposed surfaces 52 (as shown in FIG. 9) of central ties 57 with skirt 42*b* resting on central shelf 74 of the top of interconnecting portion 56 and because of the engagement of trim 72*b* with edge 53, inner depending surface 43*b* abuts against surface 52 making a push fit therewith, (c) platform 4 makes a similar push fit into the second (or transverse) coupling of foot 6, (d) outer and inner depending surfaces 41*a* and 43*a* enter between opposed surfaces 51 of foot 5 (as shown in FIG. 8), and (e) fins 47 make a push fit between inclined upstanding walls 65 of foot 6 (as shown in FIG. 10) and rib 46 rests on central shelves 73 of foot 6.

During assembly, the ends of skirts 42*a* and 42*b* and of rib 46 slide down appropriate slopes 58, 59 or 68 and so guided onto appropriate shelves 73 or 74.

Next, outer and inner depending surfaces of platform 2 are similarly lowered into foot 5 and one of feet 6 so as to be diagonally adjacent platform 4.

Finally, to complete the assembly of the base, outer and inner depending surfaces of platforms 1 and 3 are similarly lowered into feet 5 and 6 laterally adjacently to platforms 2 and 4 whereupon:

(a) outer depending surface 11*b* of skirt 12*b* of platform 1 abuts against opposed outer surface 41*b* of skirt 42*b* of platform 4 making a push fit (FIGS. 9 and 11), and (b) outer depending surface 31*a* of skirt 32*a* of platform 3 abuts against opposed outer surface 41*a* of skirt 42*a* of platform 4 urging lugs 34*a* and 44*a* against walls 55 so that inner depending surfaces 33*a* and 43*a* of lugs 34*a* and 44*a* make a push fit against opposed surfaces 51 of walls 55, and (c) similar push fits involving platform 2 are also made.

In the completely assembled base, outer depending surfaces of coupled laterally adjacent platforms abut one another while inner dependent surfaces abut upstanding surfaces of the coupling. For example, outer depending surface 41*a* of platform 4 abuts outer depending surface 31*a* of platform 3 while their respective inner depending surfaces 43*a* and 31*a* abut upstanding surfaces 51 of foot 5. These combined abutments do not merely serve to hold platforms 3 and 4 together. They also create a locking effect which resists separation of the platforms 3 and 4 by forces which tend to rotate platform 3 relative to platform 4, for example, the forces generated when someone sits on flanges 7*a* or lifts trim 72*a*. The locking effect occurs because if such a force is exerted, opposed outer depending surfaces 41*a* and 31*a* react against each other and inner depending surfaces 33*a* and 43*a* react against upstanding surfaces 51 of foot 5 and so rotation about an axis parallel to edges 3*a* and 4*a* is resisted. Similar resistance to such rotations is provided by reactions involving other outer and inner depending surfaces of platforms 1, 2, 3 and 4. Nevertheless, platforms 1, 2, 3 and 4 can be easily separated by a lifting force applied vertically upwards to a platform provided the force does not apply any significant moment to the platform. Because such a force needs to be applied at about the centre of gravity of the platform or at points so spaced that the resultant moment is about zero, it is not a force likely to be applied unintentionally and so the danger of unintentional separation of the platforms is minimal.

Hence, a base can be quickly, easily and safely assembled by hand from platforms 1, 2, 3 and 4 without the need to use tools. This is achieved simply by lowering the depending surfaces of the platforms into engagement with the upstanding surfaces of the feet 5 and 6. The weight of the platforms together with any load they might support biasses them into coupling engagement with the feet and resists any tendency for the coupling engagement to work loose. Because the platforms make only a push fit in the coupling they are easily separated by an upwards jerk and because they are large components they are easy to grip by hand.

Platforms 1, 2, 3 and 4 and feet 5 and 6 may contain apertures to reduce their weight and to economise on the material used in their construction. The platforms 1, 2, 3, 4 and feet 5 and 6 are preferably made from polypropylene structural foam.

In foot 5, notches 76 and the gaps defined by shelves 74, slopes 59 and the edges of surfaces 52 represent potential sources of weakness in foot 5. A modified foot 105 which does not have such notches or gaps is shown in FIG. 12. A modified platform 101 for use with foot 105 is shown in FIG. 13. Platform 101 is assembled on foot 105 opposite a laterally adjacent platform 104 of opposite hand as shown in FIGS. 14 and 15. Assembled platforms 101 and 104 have opposed abutting edges 101*a* and 104*a*. To make a base for a double bed, platforms 101 and 104 are assembled with diagonally adjacent similar platforms on foot 105 and on a pair of similar flanking supporting feet according to the method described and illustrated with refrence to FIG. 1.

Platform 101 has inner depending surfaces 143*a* and 143*b* provided by pegs 144*a* and lugs 144*b* respectively and it has outer depending surfaces 141*a* and 141*b* (shown in FIG. 14) provided by depending skirts 142*a* and 142*b* respectively. Inner depending surfaces 141*a* extend downwardly from squat rib 80 which is parallel to skirt 142*a*. Foot 105 has six upstanding turrets 81 having side walls 155 inclined 2° from vertical and which provide opposed upstanding spaced surfaces 151 restrained from moving apart by interconnecting walls 157. Opposed upstanding spaced surfaces 159 for the transverse coupling are provided by wedged ends of protrusions 82 which extend into space 83 between central turrets 81.

During assembly of the base, pegs 144*a* and lug 144*b* of platform 101 are lowered respectively into turrets 81 and space 83 until rib 80 rests on turrets 81. Engagement of trim 172*b* over an end of foot 105 causes inner depending surface 143*b* to abut upstanding surface 159 with which it makes a push fit. Platform 104 is similarly lowered onto foot 105 whereupon edge 104*a* opposes edge 101*a* and opposed abutting surfaces 141*b* make a push fit with each other.

Next a platform 102 identical with platform 104 is lowered onto foot 105 so as to be laterally adjacent platform 101 (as shown in FIG. 15) and diagonally adjacent platform 104. Outer depending surface 102*a* of platform 102 abuts outer depending surface 101*a* of platform 101 with a push fit which urges inner depending surfaces 143*a* against upstanding surfaces 151. The base is completed by lowering a fourth platform onto foot 105 so as to be diagonally adjacent platform 101. The base is then held together by locking effects as described with reference to FIGS. 1 to 11.

The bases described and illustrated with reference to FIGS. 1 to 15 have feet which are separate from the platforms and which therefore must be at least approximately aligned before assembly of the base. FIG. 16 illustrates a platform 201 suitable for a base for a single bed and which has integral feet 205 and 206 and an integral box 84 for engagement in a foot 205 of a laterally adjacent platform 202 as shown in FIGS. 18 to 20. The side and end walls of foot 205 and box 84 are inclined 2° to vertical to facilitate assembly of the base. Otherwise platform 201 is similar to platform 4 in that it has a surface 210 for use in supporting a prostrate human body, an edge 201*a* from which depends a skirt 242*a* which provides an outer depending surface 241*a*. An inner depending surface 243*a* (shown in FIG. 17) is provided by box 84.

To assemble the base, two identical platforms 201 are placed end to end with their unflanged edges adjacent and parallel and with each foot 205 near to the box 84 of the adjacent platform. A longitudinal edge 201*b* of one platform 201 is then raised while the diagonally opposite longitudinal edge 201*b* of the other platform 201 is also raised so that the platforms 201 assume the crossed position shown diagrammatically in FIG. 18. This operation is best performed by two people each raising one of the edges 201*b*. Platforms 201 are then drawn together so that the central portions of their opposed outer depending surfaces 241*a* abut whereupon each box 84 overlies the foot 205 of the adjacent platform. Edges 201*b* are then lowered along the arcs indicated by the arrows in FIG. 18 whereupon each box 84 comes to rest with a push fit in the foot 205 of the adjacent platform as shown diagrammatically in FIG. 19 and in plan in FIG. 20. Each foot 205 supports a box 84 so the weight of and any load on platforms 201 biasses boxes 84 into feet 205.

Any tendency for one platform 201 to rotate relative to the other about edge 201*a* is resisted by reaction between opposed outer depending surface 241*a* and reactions between inner depending surfaces 243*a* of boxes 84 and rims 86 of feet 205. Nevertheless, intentional separation of platforms 201 is easily possible by lifting simultaneously a pair of diagonally opposed longitudinal edges 201*b* of platforms 201 provided the lifting forces do not exert a significant moment about edge 201*a*. Such an operation is unlikely to occur accidentally and so the danger of unintentional separation of platforms 201 is negligible. Optionally platforms 201 may be made broad enough for use in a base for a double bed.

In the performance of this invention it is preferred for ease of assembly that any off-vertical upstanding surfaces have an angle of inclination to the vertical of up to 10°, preferably from 2° to 8°. The inclination also assists in achieving a good push fit.

A pair of platforms suitable for use in assembling a single bed may weigh as little as 5 to 12 kg. Likewise, a set of four platforms for a double bed may weigh as little as 8 to 25 kg when made from structural foam propylene polymers according to this invention. A similar structural foam foot may weigh as little as 1.5 to 4 kg so that a base for a single bed comprising two platforms and three feet may weigh about 6 to 20 kg (usually 6 to 12 kg) and a base for a double bed comprising four platforms and three feet may weigh about 12 to 37 kg (usually 12 to 25 kg). Each of the platforms illustrated in FIG. 1 fit conveniently into the trunk of a large number of motor cars and are easily packaged.

I claim:

1. A base for a bed, the base comprising at least one pair of coupled laterally adjacent thermoplastics platforms having horizontal surfaces for supporting a prostrate human body, and at least one coupling which holds together a pair of laterally adjacent platforms in such a way that an edge of one platform of a pair is opposed to an edge of the other platform of the pair wherein:

(a) the coupling comprises opposed upstanding spaced surfaces restrained from moving apart by at least one interconnection, (b) each platform of a laterally adjacent pair is provided with:

(i) an outer depending surface which extends downwards and opposes an outer depending surface of the other platform of the pair, and (ii) an inner depending surface which extends downwards and enters between the upstanding surfaces of the coupling, and opposes an upstanding surface, whereby reaction between the opposed outer depending surfaces and reaction between an inner depending surface and the upstanding surface resists a rotation of one platform of a pair relative to the other platform about an axis parallel to their opposed edges.

2. A base according to claim 1 wherein the opposed upstanding surfaces of the coupling, are inclined at an angle of up to 10° to the vertical and the inner depending surfaces of the platforms are correspondingly inclined so as to make a push fit with the inclined opposed upstanding surfaces.

3. A base according to claim 1 or claim 2 wherein the opposed upstanding surfaces and the interconnections of the coupling each forms part of a support for a platform.

4. A base according to claim 3 wherein the outer depending surfaces are provided by skirts depending from opposed edges of laterally adjacent platforms and the inner depending surfaces are provided by lugs which extend from the skirts to abut against opposed upstanding surfaces of the coupling.

5. A base according to claim 3 wherein the supports for the platforms are integral with one or other of the platforms and all the platforms are identical or of opposite hand.

6. A base for a bed, the base comprising at least four thermoplastics platforms having horizontal surfaces for supporting a prostrate human body, said platforms being arranged in diagonally adjacent pairs and laterally adjacent pairs, each laterally adjacent pair being held together with edges opposed by a coupling which cooperates with the pair of platforms to provide a locking effect which resists relative rotation of the pair of platforms about an axis parallel to their opposed edges, wherein:

(a) the coupling comprises opposed upstanding spaced surfaces restrained from moving apart by at least one interconnection, (b) each platform of a laterally adjacent pair is provided with:

(i) an outer depending surface which extends downwards and opposes an outer depending surface of the other platform of the pair, and (ii) an inner depending surface which extends downwards and enters between the upstanding surfaces of the coupling, and opposes an upstanding surface;

whereby reaction between the opposed outer depending surfaces and reaction between an inner depending surface and the upstanding surface resists a rotation of one platform of a pair relative to the other platform about an axis parallel to their opposed edges.

7. A base according to claim 6 comprising a coupling having first opposed upstanding surfaces which hold together a first pair of laterally adjacent platforms having opposed edges, and the coupling also comprising second opposed upstanding surfaces transverse to the first and restrained from moving apart by at least one interconnection wherein the second upstanding surfaces hold together a second pair of laterally adjacent platforms having opposed edges transverse to the opposed edges of the first pair of laterally adjacent platforms.

8. A base for a bed comprising two laterally adjacent thermoplastics platforms having horizontal surfaces for supporting a prostrate human body said platforms being coupled together in such a way that an edge of one is opposed to an edge of the other; wherein each of said platforms includes:

(a) primary coupling means comprising opposed upstanding spaced surfaces restrained from moving apart by at least one interconnection;

(b) skirt means providing an outer depending surface; and (c) secondary coupling means comprising an inner depending surface;

said first and second coupling means comprising means for insuring that the outer depending surface for each platform opposes the outer depending surface of the other platform so that said secondary coupling means of each platform engages with said primary coupling means of the other platform in such a manner that the inner depending surface of said secondary coupling means extends downwards and enters between the upstanding surfaces of said primary coupling means and opposes an upstanding surface.

* * * * *